US005154090A

United States Patent [19]

Konishi

[11] Patent Number: 5,154,090

[45] Date of Patent: Oct. 13, 1992

[54] COAXIAL STARTER

[75] Inventor: Keiichi Konishi, Hyogo, Japan

[73] Assignee: Mitsubishi Denki K.K., Tokyo, Japan

[21] Appl. No.: 753,551

[22] Filed: Sep. 3, 1991

[30] Foreign Application Priority Data

Sep. 28, 1990 [JP] Japan ..... 2-261279

[51] Int. Cl.[5] ..... F02N 11/00

[52] U.S. Cl. ..... 74/7 E; 74/7 A; 74/7 C

[58] Field of Search ..... 74/7 A, 7 C, 7 E

[56] References Cited

U.S. PATENT DOCUMENTS

| | | | |
|---|---|---|---|
| 4,464,576 | 8/1984 | Williams | 74/7 C X |
| 4,779,470 | 10/1988 | Morita et al. | 74/7 E X |
| 4,881,416 | 11/1989 | Isozumi . | |
| 4,918,324 | 4/1990 | Isozumi | 74/7 A X |
| 4,924,108 | 5/1990 | Isozumi | 74/7 E X |
| 4,926,706 | 5/1990 | Isozumi | 74/7 E X |
| 4,945,777 | 8/1990 | Isozumi . | |
| 4,947,052 | 8/1990 | Isozumi | 74/7 C X |
| 4,987,786 | 1/1991 | Morishita et al. | 74/7 E X |
| 4,989,467 | 2/1991 | Morishita et al. | 74/7 C X |

FOREIGN PATENT DOCUMENTS

| | | | |
|---|---|---|---|
| 57-165663 | 10/1982 | Japan | 74/7 E |
| 58-77165 | 5/1983 | Japan | 74/7 E |

*Primary Examiner*—Allan D. Herrmann
*Assistant Examiner*—Julie Krolikowski
*Attorney, Agent, or Firm*—Sughrue, Mion, Zinn Macpeak & Seas

[57] ABSTRACT

A coaxial starter including: an electric motor, an output shaft having a pinion mounted to the front end thereof and engaging the pinion with a ring gear in an engine when it is advanced and to disengaging the pinion from the ring gear when it returns. An electromagnetic switch is provided for advancing the output shaft when an excitation coil is energized and for closing a contact in a circuit electric motor. A planetary gear reduction device reduces the rotation of an armature shaft of the motor and an over-running clutch transmits the reduced rotation to the output shaft. An axially extending annular projection is provided in the outer peripheral front portion of a planetary gear frame of the planetary gear reduction device, an annular groove is formed in the outer peripheral portion of the projection and the inner peripheral portion of the annular projection is fitted with the outer peripheral portion of a clutch outer part of the over-running clutch so that it is slidable in the circular direction thereof if a rotational torque exceeds a predetermined value. A front end of a cylindrical portion is provided in the outer periphery of a coupling cap so as to press against a stiffening plate provided in the front end of the clutch outer. The coupling cup is staked into the annular groove formed in the annular projection to thereby couple the planetary gear frame to the over-running clutch in the axial direction thereof.

5 Claims, 2 Drawing Sheets

COAXIAL STARTER

Related to this application is its priority application No. P. Hei 2-261279 filed in Japan on Sep. 28, 1990, the content of which is incorporated herein by reference.

BACKGROUND OF THE INVENTION

The present invention relates to a coaxial starter including an armature shaft of an electric motor, an output shaft with a pinion fixed to the end thereof, and an operating rod of an electromagnetic switch which are arranged coaxially with one another and, in particular, to improved coupling means for coupling a planetary gear frame to a clutch outer.

FIG. 2 shows a section view of a coaxial starter according to the prior art. In FIG. 2, DC electric motor 1 is constructed in the following manner: a permanent magnet 2 is mounted to a yoke 3. An armature 4 is composed of an armature iron core 5 fixed to a hollow armature shaft 6, an armature coil 7, and a commutator 8. A rear bracket 9 is mounted to the yoke 3. The armature shaft 6 is supported through bearings 10 and 11 by the front end support portion 3*a* of the yoke 3 and also by the rear bracket 9. A brush holder 12 presses a brush 13 against the commutator 8.

A planetary gear reduction device 15 is used to reduce the rotational speed of the armature shaft 6 and then transmit the reduced speed. The reduction device 15 is constructed in the following manner: A sun gear 6*a* is composed of a pinion which is formed in the end portion of the armature shaft 6. A frame member 16 is mounted to the yoke 3 and having an internal gear 17 for serving as an inner bracket as well. A plurality of planetary gears 18 mesh with the sun gear 6*a* and revolve on its axis as well as mesh with the internal gear 17 and revolve round the internal gear 17 in a reduced manner, and a planetary gear frame 19 is supported through a ball bearing 33 by the armature shaft 6 and in turn supports the planetary gears 18 through a bearing 21 by a fixed support pin 20 to transmit the revolution of the planetary gears 18 round the internal gear 17.

An output shaft 22, one end of which is supported through a bearing 23 in a hollow bore formed in the armature shaft 6. And a pinion 24 is spline coupled to the other end of the output shaft 22 and is covered by a stopper 25 so that the pinion 24 is prevented from slipping off of the output shaft 22.

An over-running clutch 26 is used to transmit the output rotation of the planetary gear reduction device 15 to the output shaft 22 by means of unidirectional rotation. The over-running clutch 26 is constructed in the following manner: The inside diametrical portion of one end of the clutch outer 27 is shrinkage fitted on to the outer periphery of a projection provided on and from one end of the planetary gear frame 19. And, the interferences of the respective fitted portions 28 of the clutch outer 27 and planetary gear frame 19 are set such that they are allowed to slide on each other if a rotational torque exceeds a predetermined value. A clutch inner 29 has an inner peripheral helical spline 29*a* in mesh with a helical spline 22*a* formed in the output shaft 22. The outer end of the clutch inner 29 is supported through a bearing 34 by the frame member 16. A plurality of rollers 30 are interposed between the clutch outer 27 and clutch inner 29. A coupling cap 31 presses against a bisected stiffening plate 32 and is staked to the outer periphery of the clutch outer 27.

The front portion of the output shaft 22 is supported through a bearing 35 by the clutch inner 29 in such a manner that it is movable in the axial direction thereof. A return spring 36 is used to move back or return the output shaft 22 after it has been advanced, and a front bracket 37 is mounted to the frame member 16 by a bolt 38.

An electromagnetic switch 40 is coaxially mounted to the rear end of the DC electric motor 1 and is constructed in the following manner: A case 41 surrounds electromagnetic switch 40 and forms a magnetic circuit and is mounted to the rear bracket 9. A fixed iron core 42 is fixed within the front end portion of the case 41, and an excitation coil 43 is wound around a bobbin supported by the case 41 and fixed iron core 42. A plunger 44 forms a movable iron core and is supported at the end of an operating rod 45 formed of a non-magnetic tubular rod. A movable contact supported by the operating rod 45 via an insulating material 47 and is pressed in the advancing direction thereof by a compression spring 48.

A push rod 49 is pressed by a compression spring 50. The rear end thereof is inserted into the operating rod 45 and the front end thereof is confronted by a steel ball 51 disposed in a recess at the real end portion of the output shaft 22. A compression spring which pushes and holds the steel ball 51 against the recess. A pair of fixed contacts 53 are embedded into and held by an insulating material 54 fixed to the rear bracket 9 and are opposed to the movable contact 46. A terminal bolt portion 55 is formed integrally in one of the fixed contacts 53 and is exposed externally, and an end cover.

The end cover 56, case 41, rear bracket 9, yoke 3 and frame member 16 are coupled/assembled by a through bolt 57.

Next, description will be given of the operation of the conventional coaxial starter constructed in the above-mentioned manner. If a starting switch provided in a vehicle is closed, then the excitation coil 43 is energized to thereby advance or move the plunger forwardly. As a result of this, the operating rod 45 is advanced together with the plunger 44, the push rod 49 is advanced through the compression spring 50, and the output shaft 22 is also moved forwardly through the steel ball 51. Then, the pinion 24 that has been advanced together is brought into mesh with a ring gear provided in an engine. At that time, the movable contact 46 that has been advanced is pressed against the two fixed contacts 53 to thereby energize the armature coil 7 of the DC electric motor 1. In this manner, the armature 4 is started to rotate, the rotation of the armature shaft 6 is reduced by the planetary gear reduction device 15, the reduced rotation is transmitted to the clutch outer 27 of the over-running clutch 26, and the rotation is transmitted to the output shaft 22 from the clutch inner 29. This starts the rotation of the engine through the pinion 24.

When the engine is started and the electrical energization to the excitation coil 43 is cut off, then the output shaft 22 is moved back or returned by the return spring 36 to thereby disconnect the pinion 24 from the ring gear, and at the same time the movable contact 46 is moved back through the push rod 49, compression spring 50 and working rod 45 to part away from the fixed contacts 53.

The above-mentioned planetary gear frame 19 and clutch outer 27 are fitted to each other in such a manner that they are allowed to slide over each other if a rotational torque exceeds a predetermined value. If an excessive shock stress occurs in a start drive system ranging from the DC electric motor 1 to the engine, for example, if the engine is started during coasting rotation, then the planetary gear frame 19 and clutch outer 27 are allowed to slide over each other in a fitted portion 28 thereof to thereby absorb the shock stress so as to prevent damage or breakage of the pinion, ring gear and the like.

As described above, according to the shock absorbing mechanism used to deal with an abnormal load applied in the above-mentioned conventional coaxial starter, the planetary gear frame 19 and clutch outer 27 are arranged so as to be slidable on the shrinkage fitted surface thereof. However, if a slight shift is produced in an axial direction during such sliding on the shrinkage fitted surface and such shift is repeatedly produced, for example, a gap between the end of the support pin 20 and the front end support portion 3*a* of the yoke 3 is then caused to disappear to thereby impede the rotational action of the planetary gear frame 19, that is, to worsen the performance of the mechanism. In the worst case, the armature 4 is prevented from rotation.

SUMMARY OF THE INVENTION

The present invention aims at eliminating the drawbacks found in the above-mentioned conventional coaxial starter. Accordingly, it is an object of the invention to provide a coaxial starter which is capable of preventing the axial shift of the planetary gear frame with respect to the clutch outer due to the abnormal load in the shock absorbing mechanism using the shrinkage fitted portion of the planetary gear frame and clutch outer and is also capable of eliminating the possibility that the rotation of the armature may be impeded.

In order to attain the above object, according to the invention, there is provided a coaxial starter in which there is provided, in the outer peripheral portion of a planetary gear frame, an annular projection which extends in the axial direction of the planetary gear frame, the annular projection is coupled to the outer peripheral portion of a clutch outer with a predetermined interference therebetween in the inner peripheral portion thereof so that they can be slided in the circular direction thereof in the case of an abnormal load of a predetermined value or more. Also, an annular groove is formed in the outer peripheral portion of the annular projection, an axially extending cylindrical portion provided in the outer peripheral portion of a coupling cap for fixing a stiffening plate disposed on the end face of the clutch outer is fitted into the outer peripheral portion of the annular projection, and the front end of the cylindrical portion is staked to the annular groove for axial coupling. Accordingly, it is possible to prevent the axial shifting of the planetary gear frame with respect to the clutch outer.

In operation, according to the invention, the planetary gear frame, more exactly, the annular projection thereof is fitted with the clutch outer with a predetermined interference therebetween, and they are coupled together in the axially direction thereof by the coupling cap, so that it is possible to prevent the axial shifting of the planetary gear frame otherwise occurring when it is slided in the case of an excessing load. This eliminates a possibility that the support pin may be brought into contact with the front end support portion of the yoke, and an impediment to the rotation of the armature can be avoided.

BRIEF DESCRIPTION OF THE DRAWINGS

The exact nature of this invention, as well as other objects, features and advantages thereof, will be readily apparent from consideration of the following specification relating to the accompanying drawings, in which like reference characters designate the same or similar parts throughout the figures thereof and wherein.

DESCRIPTION OF THE PREFERRED EMBODIMENT

Detailed description will hereunder be given of the preferred embodiment of a coaxial starter according to the present invention with reference to the accompanying drawings.

Figure 1:
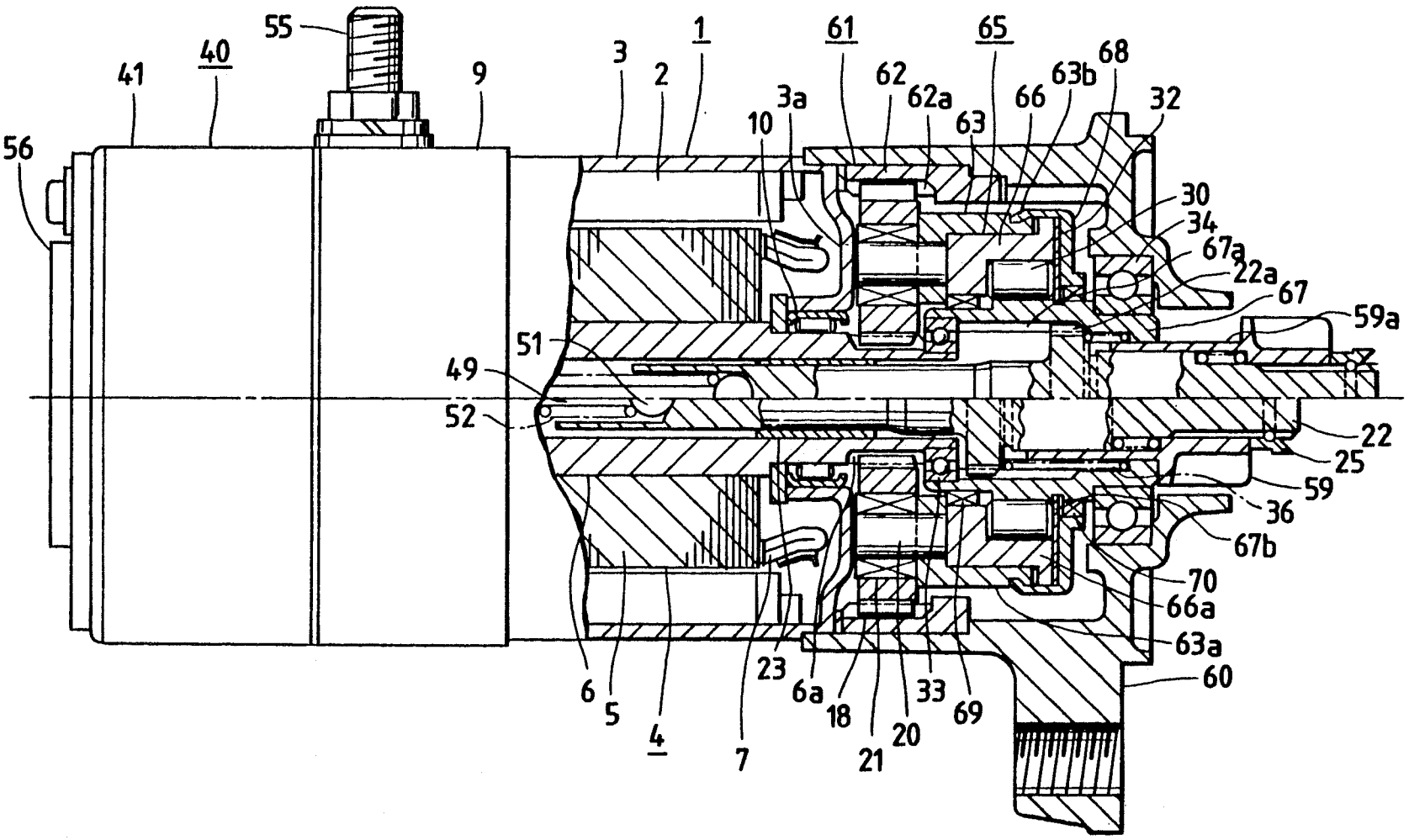
FIG. 1 is a front view of an embodiment of a coaxial starter according to the invention, illustrating in section the front half section thereof; and, FIG. 2 is a longitudinal section view of a conventional axial starter.
Figure 2:
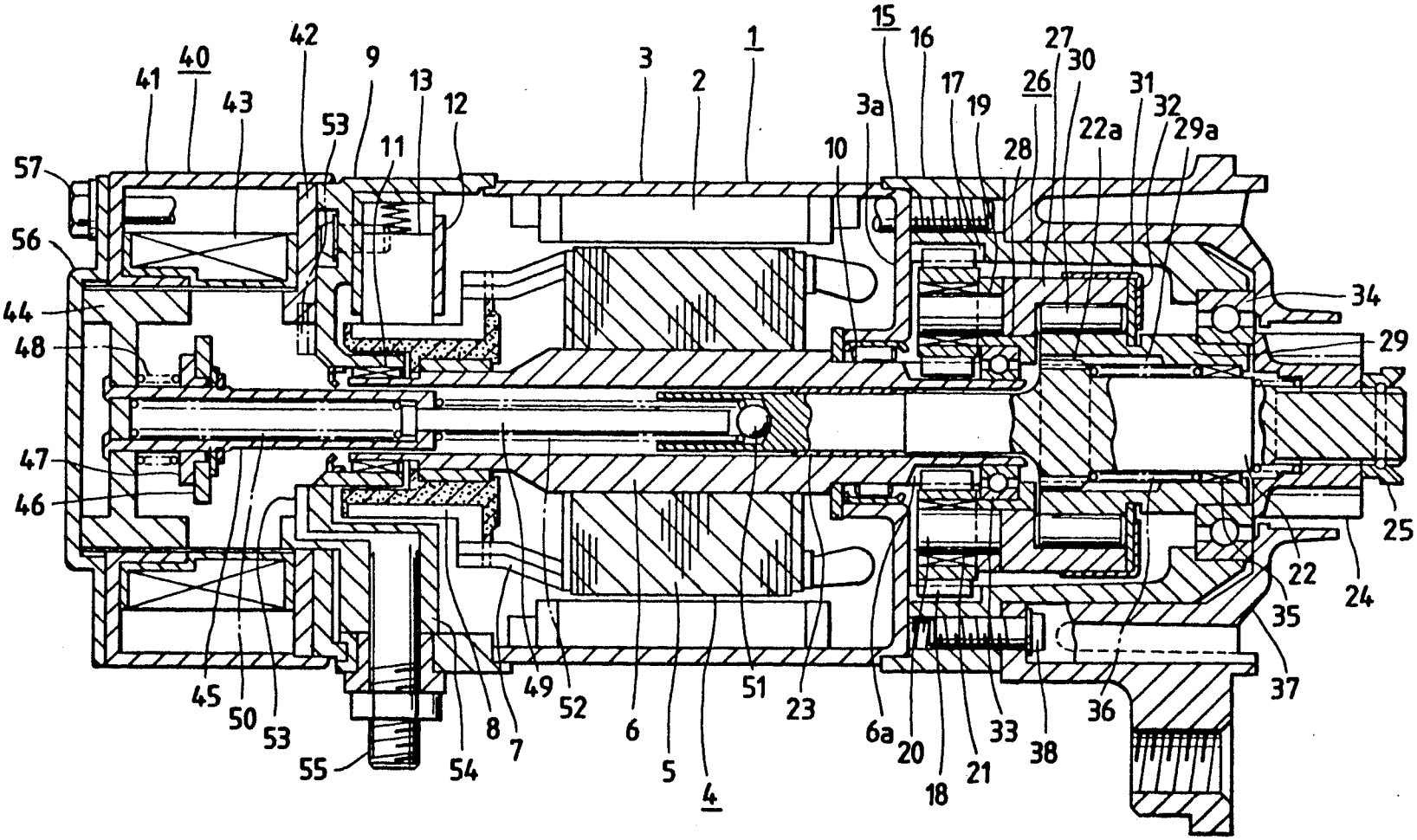
FIG. 2 PRIOR ART

Referring now to FIG. 1, there is shown a front view of an embodiment of a coaxial starter according to the invention, illustrating in section the front half section thereof. In FIG. 1, reference characters 1–7, 9, 10, 18, 20–23, 25, 30, 32–34, 40, 41, 55, 56, 3*a*, 6*a*, and 22*a* designate the same parts as in the above-mentioned conventional coaxial starter and thus the description thereof is omitted here. In FIG. 1, a pinion 59 is spline-coupled to the end of the output shaft 22 and includes a sleeve 59*a* extending in and from the rear portion, thereof. A front bracket is mounted to the front end of the yoke 3. A planetary gear reduction device 61 is coaxially mounted to the front portion of the DC electric motor 1. The planetary gear reduction device 61 is constructed in the following manner: an internal gear frame 62 is formed of, for example, a synthetic resin material having a large mechanical strength, includes an internal gear 62*a* in the inner peripheral portion thereof, and is fixed within the front bracket 60. A planetary gear frame 63 has a plurality of support pins 20 are mounted thereon. The planetary gear frame 63 includes an axially extending annular projection 63*a* in the outer peripheral portion thereof and an annular groove 63*b* in the outer peripheral portion of the annular projection 63*a*. The planetary gear 18 is supported through the bearing 21 by the support pins 20 and the planetary gear 18 is meshed with the sun gear 6*a* composed of the pinion of the armature shaft 6 and revolves on its axis, and at the same time is meshed the internal gear 62*a* and revolves round the internal gear 62*a*, thereby transmitting the reduced revolution.

Reference numeral 65 designates an over-running clutch which transmits the rotation from the planetary gear reduction device 61 to the output shaft 22 by means of unidirectional rotation. The clutch 65 is constructed in the following manner: A clutch outer 66 has a cylindrical portion 66*a* for holding the roller 30. The outer 66 is arranged in such a manner that, after the inner peripheral portion of the annular projection 63*a* of the planetary gear frame 63 is shrinkage coupled to the outer peripheral portion of the cylindrical portion 66*a* with a predetermined interference. If a rotational torque exceeds a predetermined value, then the outer 66 allows the two shrinkage coupled portions to slide in the circular direction thereof with respect to each other to thereby be able to absorb the shock loads applied. A clutch inner 67 is provided with the roller 30 interposed between the clutch outer 66 and inner 67. The clutch inner 67 includes one end which is supported through the ball bearing 33 by the armature shaft 6, while the other end thereof is supported through the ball bearing 34 by the front bracket 60. The clutch inner 67 includes a helical spline 67*a* in the inner peripheral portion thereof and the helical spline 67*a* is engaged with the helical spline 22*a* of the output shaft 22, so that the revolution or rotation can be transmitted to output shaft 22. The output shaft 22 is normally moved back or returned by the return spring 36 which is axially inserted into the output shaft 22 as well as into the clutch inner 67. Reference numeral 68 designates a coupling cap for pressing a bisected stiffening plate 32. The cap 68 includes in the outer peripheral portion thereof a cylindrical portion the end of which is staked into an annular groove 63*b* formed in the planetary gear frame 62. By means of this, the planetary gear frame 62 is coupled to the clutch outer 66 so that it cannot be shifted in the axial direction thereof. Bearings 69 and 70 are respectively interposed between the clutch outer 66, coupling cap 68 and the clutch inner 67. The two bearings 69 and 70 are used to keep the clutch outer 66 coaxial with the clutch inner 67.

Since the inner peripheral portion of the stiffening plate 32 is inserted into an annular groove 67*b* formed in the outer peripheral portion of the clutch inner 67, the axial movements of the planetary gear frame 63 and clutch outer 66 are limited to a very slight range. Also, the clutch inner 67 is supported in such a manner that it cannot be moved axially by the ball bearings 33 and 34.

Even when the planetary gear frame 62 and clutch outer 66 may be mutually slided in the circular direction thereof in their shrinkage coupled portions due to the shock loads applied, both of them remain integrally coupled to each other in the axial direction thereof by means of the coupling cap 68, thereby eliminating the possibility that the front end of the support pin 20 may be brought into contact with the front end portion 3*a* of the yoke 3, so that the rotation of the armature 4 cannot be impeded.

As has been described heretofore, according to the invention, there is provided an axially extending annular projection in the outer peripheral portion of a planetary gear frame, an annular groove is formed in the outer peripheral portion of the annular projection, the annular projection or the inner peripheral portion thereof is fitted with the outer peripheral portion of a clutch outer with a predetermined interference so that they are slidable in the circular direction with respect to each other if an abnormal load of a predetermined value or more is applied, and the clutch outer peripheral portion is staked and axially coupled to the annular groove in the annular projection the planetary gear frame by means of a cylindrical portion end in the outer peripheral portion of a coupling cap which fixes a stiffening plate provided on the end face of the clutch outer, so that, even if the planetary gear frame is slided in the circular direction thereof with respect to the clutch outer, the planetary gear frame will never be shifted in the axial direction thereof, which prevents support pins from contacting with the front end support portion of a yoke and thus any impediments to the rotation of an armature due to such contact can be eliminated.

The present invention is not confined to the embodiments and modifications described above, but may be embodied or practiced in other various ways without departing from the spirit or essential character of the invention as defined in the appended claims.

What is claimed is:

1. A coaxial starter comprising:

an electric motor (1) including a hollow armature shaft (6);

an output shaft (22) movable in the axial direction thereof and including a pinion (59) mounted to a front end thereof, said output shaft being adapted to engage the pinion with a ring gear in an engine when said output shaft advances from an initial position and to disengage the pinion from the ring gear when said output shaft returns to the initial position;

an electromagnetic switch (40) disposed on a side of the electric motor (1) opposite said output shaft and operatively coupled to said output shaft by a connecting member so as to advance said output shaft (22) when an excitation coil attached to said motor is energized and so as to close a contact in a circuit associated with said electric motor to thereby rotate an armature shaft (6);

a planetary gear reduction device (61) coupled to said electric motor (1) and configured so as to reduce the rotation of said armature shaft (6), said planetary gear reduction device (61) having a planetary gear frame (63);

an over-running clutch (65) coupled to said planetary gear reduction device so as to transmit the reduced rotation to said output shaft, said over-running clutch (65) having a clutch inner member (67) and a clutch outer member (66);

an axially extending annular projection (63*a*) provided in the outer peripheral front portion of said planetary gear frame (63), said projection (63*a*) having an annular groove (63*b*) formed in an outer peripheral portion thereof, an inner peripheral portion of said annular projection (63*a*) being fitted with an outer peripheral portion of said clutch outer member (66) so as to cause said planetary gear frame to be slidable relative to said clutch outer member in a circular direction thereof if a rotational torque exceeds a predetermined value; and a coupling cap (68) having a front end of a cylindrical portion provided in the outer periphery thereof, said front end being engaged with said annular groove formed in said annular projection, a portion of said coupling cap being engaged with said over-running clutch so as to couple said planetary gear frame to said over-running clutch in the axial direction thereof.

2. A coaxial starter according to claim 1, further comprising a stiffening plate (32) provided proximate a front end of said clutch outer member, said stiffening plate (32) being pressed by said coupling cap (68).

3. A coaxial starter according to claim 2, wherein said clutch inner member has a recess formed on an outer peripheral surface thereof and a portion of said stiffening plate is engaged with said recess so as to couple said clutch inner member to said clutch outer member and said planetary gear frame in the axial direction.

4. A coaxial starter according to claim 1, in which said clutch inner member (67) is supported, by a pair of bearings, in such a manner that said clutch inner member (67) cannot be moved axially.

5. A coaxial starter according to claim 1, further comprising a pair of bearings (69 and 70) for keeping the clutch outer member coaxial with said clutch inner member (67), in which one of said bearings (70) is interposed between said clutch inner (67) and said coupling cap (68).

* * * * *